US007938695B2

(12) United States Patent
Furutani et al.

(10) Patent No.: US 7,938,695 B2
(45) Date of Patent: May 10, 2011

(54) TERMINAL FITTING

(75) Inventors: Mitsugu Furutani, Yokkaichi (JP); Tomonari Itou, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/643,447

(22) Filed: Dec. 21, 2009

(65) Prior Publication Data

US 2010/0173539 A1 Jul. 8, 2010

(30) Foreign Application Priority Data

Jan. 8, 2009 (JP) ..... 2009-002393
Jan. 8, 2009 (JP) ..... 2009-002408

(51) Int. Cl.
*H01R 11/22* (2006.01)

(52) U.S. Cl. ..... 439/852

(58) Field of Classification Search ..... 439/852, 439/595, 851, 853, 854–856
See application file for complete search history.

(56) References Cited

U.S. PATENT DOCUMENTS

| | | | | |
|---|---|---|---|---|
| 6,379,199 | B1 * | 4/2002 | Chen | 439/852 |
| 7,101,233 | B2 * | 9/2006 | Maeda | 439/852 |
| 7,470,159 | B2 * | 12/2008 | Hara | 439/852 |
| 2005/0101198 | A1 * | 5/2005 | Maeda | 439/852 |
| 2010/0130075 | A1 * | 5/2010 | Casses et al. | 439/852 |

FOREIGN PATENT DOCUMENTS

| | | |
|---|---|---|
| JP | 07-045322 | 2/1995 |
| JP | 2006-120370 | 5/2006 |

* cited by examiner

*Primary Examiner* — Jean F Duverne
(74) *Attorney, Agent, or Firm* — Gerald E. Hespos; Michael J. Porco

(57) ABSTRACT

A terminal fitting (10) has a rectangular tube (11) for receiving a mating male tab (90). A resilient contact (18) is formed in the rectangular tube (11) and can resiliently contact the male tab (90). An excessive deformation preventing portion (41) is formed in the rectangular tube (11) for preventing deformation of the resilient contact (18) beyond a resiliency limit by contacting the resilient contact (18) being resiliently deformed. The terminal fitting (10) also has an extending portion (33) projecting out from an end edge of the rectangular tube portion (11) in a developed state before being bent and arranged at an outer side of the resilient contact (18) after being bent. The excessive deformation preventing portion (41) is formed by bending a part of the extending portion (33) into the interior of the rectangular tube (11).

12 Claims, 8 Drawing Sheets

TERMINAL FITTING

BACKGROUND OF THE INVENTION

1. Field of the Invention

The invention relates to a terminal fitting.

2. Description of the Related Art

Japanese Unexamined Patent Publication No. 2006-120370 discloses a terminal fitting formed by bending an electrically conductive metal plate. The terminal fitting has a rectangular tube for receiving a mating male tab and a resilient contact is in the rectangular tube for resiliently contacting the male tab. The rectangular tube has a bottom plate below the resilient contact and two parallel slits are cut in the bottom plate. A tongue located between the slits is pushed into the interior of the rectangular tube from the outer side to form an excessive deformation preventing portion that prevents deformation of the resilient contact beyond a resiliency limit. The bottom plate of this terminal fitting must be sufficiently wide to form the two slits and the tongue. However, there typically is not sufficient space in the bottom plate of a small terminal fitting. Hence, it is nearly impossible to provide an excessive deformation preventing portion in a small terminal fitting.

Japanese Unexamined Patent Publication No. H07-45322 discloses technology for increasing a contact pressure between a male tab inserted into a rectangular tube and a resilient contact in a female terminal fitting. The resilient contact of the terminal fitting is formed by folding a member extending from the front end of a bottom wall of the rectangular tube in a rearward direction. Cutouts are formed at positions in opposite side walls of the rectangular tube at positions corresponding to a base end of the resilient contact. The cutouts provide additional space for the base of the resilient contact piece. The base end of the resilient contact is a part where a resilient restoring force accumulates when the resilient contact is deformed. Thus, contact pressure between the resilient contact and the male tab can be increased by increasing the width of the base end.

However, areas of the side walls at to the base end of the resilient contact are cut over the entire width of the rectangular tube. Thus, the base of the resilient contact is exposed to the outside and may be damaged. Conversely, narrowing the base of the resilient contact to eliminate the possibility of damage from external forces may decrease stability for the resilient contact, thereby increasing the likelihood of contact with the side walls of the rectangular tube.

In view of the above, it is an object of the invention to develop a suitable resilient contact for a small-sized terminal fitting.

A further object is to provide a resilient contact with sufficient stability to avoid unintended deformation, while not exposing the resilient contact to external forces that may induce damage.

SUMMARY OF THE INVENTION

The invention relates to a terminal fitting formed by bending an electrically conductive metal plate. The terminal fitting preferably has a substantially rectangular tube for receiving a mating male tab. The rectangular tube has a base plate and opposite side plates extend vertically from the left and right edges of the base plate. A resiliently deformable contact is formed in the rectangular tube for resiliently contacting the male tab. An extending portion projects out from an end edge of the rectangular tube and is bent so that an end of the extending portion extends into the interior of the tube. The end of the extending portion extending into the rectangular tube defines an excessive deformation preventing portion and prevents deformation of the resilient contact beyond a resiliency limit. The excessive deformation preventing portion is formed on an edge of the metal plate and hence can be used in a small terminal fitting without sufficient space in the interior of the rectangular tube to accommodate the entirety of an excessive deformation preventing portion.

A stabilizer preferably is formed as part of the extending portion for guiding the terminal fitting into a connector housing and preventing an erroneous insertion into the housing. The combination of the extending portion and the stabilizer saves space on the outer surface of the terminal fitting and is particularly beneficial when utilized on small terminal fittings.

The excessive deformation preventing portion preferably is formed by bending a part of the extending portion that projects from an end edge of a region forming the stabilizer into the interior of the rectangular tube. This method of forming the excessive deformation preventing portion allows a number of different shapes and sizes to be created for the excessive deformation preventing portion without altering the shape or size of the stabilizer.

The excessive deformation preventing portion preferably has a plate surface arranged substantially along an inserting direction of the male tab. Thus, the rectangular tube is not enlarged in a width direction orthogonal to the inserting direction of the male tab and the terminal fitting can be miniaturized even further.

The resilient contact preferably extends substantially in an inserting direction of the male tab from a support at a base end of the resilient contact piece to a leading end thereof. A support preferably is formed in the rectangular tube and extends from a base end to a leading end in a direction substantially opposite to the inserting direction of the male tab. The resilient contact and the support overlap in a resilient deforming direction, thereby efficiently utilizing the area inside the rectangular tube.

At least one bottomed recess is formed in the inwardly facing surface of at least one of the opposite side plates for permitting the resilient contact to escape. The recess for permitting the resilient contact to escape is formed at a position of the inner surface of at least one of the side plates to include the range in which the resilient contact piece is displaced resiliently. Thus, interference of the resilient contact piece with the side plate is avoided and a smooth deformation of the resilient contact is ensured even if the male tab deforms the resilient contact in an off-center manner. Further, the recess is bottomed so that the lateral edge of the resilient contact is covered by the side plate. Therefore external interference with the resilient contact from a lateral side is prevented. Accordingly, the terminal fitting can be miniaturized while protecting a resilient contact from an external matter and ensuring smooth deformation of the resilient contact.

The at least one recess preferably is arranged within the thickness of the side plate so that the recess does not increase the width of the rectangular tube. Thus, the width of a cavity of a connector housing that receives the terminal fitting is not increased and the terminal fitting and a connector can be miniaturized.

A base end of the resilient contact is a supporting point for resilient deformation and is wider than a leading end portion of the resilient contact piece. The recess preferably is formed in a range that includes at least the base end of the resilient contact. Thus, the resilient rigidity of the base end is increased to ensure a large contact pressure between the resilient contact and the male tab. The base end preferably faces an insertion opening of the tube for the male tab. Hence, the male tab is more difficult to rotate about an axis due to contact with the resilient contact, thereby ensuring a smooth insertion of the male tab.

The recess preferably is at a position in the rectangular tube substantially opposite the insertion opening for the male tab. Thus, a distance between the inner surfaces of the side plates can conform to the width of the male tab and the insertion opening of the tube. Thus, the male tab will not shake in a width direction at an initial stage of the insertion into the rectangular tube.

The at least one recess preferably is in a part of a height range of the side plate extending along the resilient deforming direction. Thus, the male tab is prevented from shaking in the width direction even after insertion into the tube.

These and other features and advantages of the invention will become more apparent upon reading the following detailed description of a preferred embodiment and accompanying drawings.

DETAILED DESCRIPTION OF THE PREFERRED EMBODIMENTS

Figure 1:
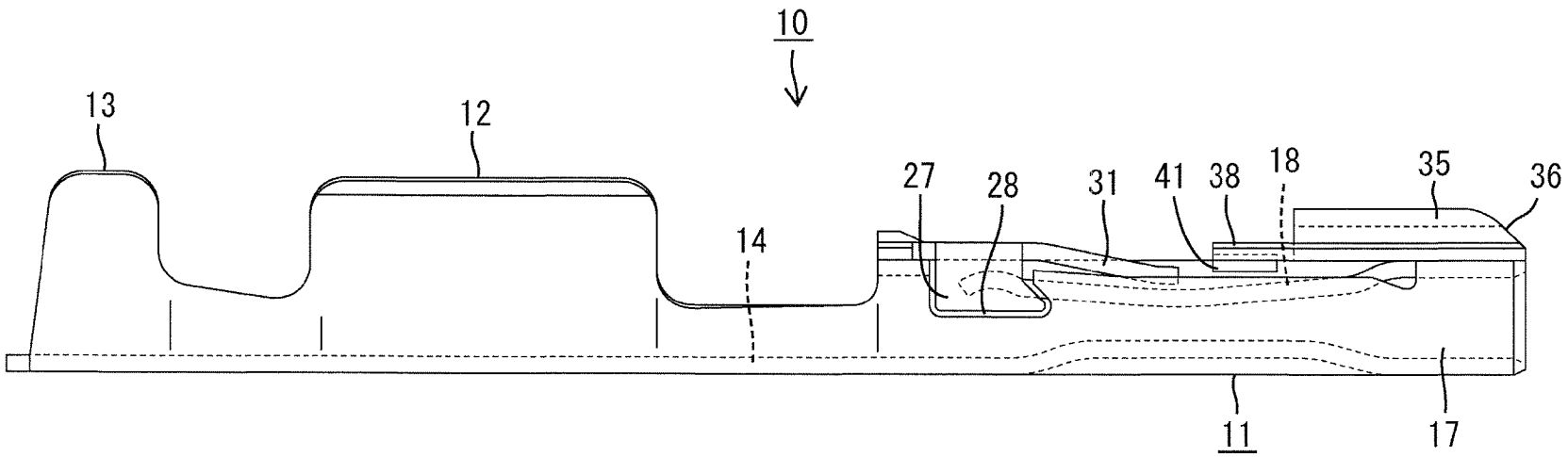
FIG. 1 is one side view of a terminal fitting according to one embodiment of the invention.

A terminal fitting 10 according to the invention is identified generally by the numeral 10 in FIGS. 1 to 8. The terminal fitting 10 is formed unitarily by bending, folding and/or embossing an electrically conductive metal plate that has been punched or cut into a specified form. The terminal fitting is to be inserted into a cavity of a connector housing and electrically connected with a mating male tab 90 by connecting the housing with a mating housing. In the following description, an end of the male tab 90 that is to be inserted is referred to as the front and reference is made to FIG. 1 concerning a vertical direction.

The terminal fitting 10 has a substantially rectangular tube 11 that is long and narrow in forward and backward directions. A wire barrel 12 is located behind the tube 11 and an insulation barrel 13 is located behind the wire barrel 12. The tube 11, the wire barrel 12, and the insulation barrel 13 share a base plate 14 in the form of a strip that is long and narrow in forward and backward directions. The wire barrel 12 has two front crimping pieces 15 that are to be crimped, bent or folded into connection with a core of an end portion of a wire placed on the base plate 14. The insulation barrel 13 has two rear crimping pieces 16 that are to be crimped, bent or folded into connection with an insulation coating of the end portion of the wire or a rubber plug (not illustrated) mounted on the insulation coating.

The tube 11 has the base plate 14 and first and second side plates 17 that project up at substantially right angles from opposite lateral sides of the base plate 14. A resilient contact 18 is bent from the first side plate 17 toward the upper end of the second side plate 17, and a support 19 is bent from the second side plate 17 toward the upper end of the first side plate 17. A widthwise intermediate part of the base plate 14 is deformed inwardly to form a receiving portion 20 that is narrow and long in forward and backward directions and bulges into the tube 11.

The resilient contact 18 and the support 19 are spaced above the base plate 14 to form a ceiling of the terminal fitting 10 and a connection area with the male tab 90. The resilient contact 18 is connected with the front end of the tube 11 and can resiliently contact the male tab 90. The support 19 is connected with the rear end of the tube 11 and resiliently supports the resilient contact 18.

Figure 4:
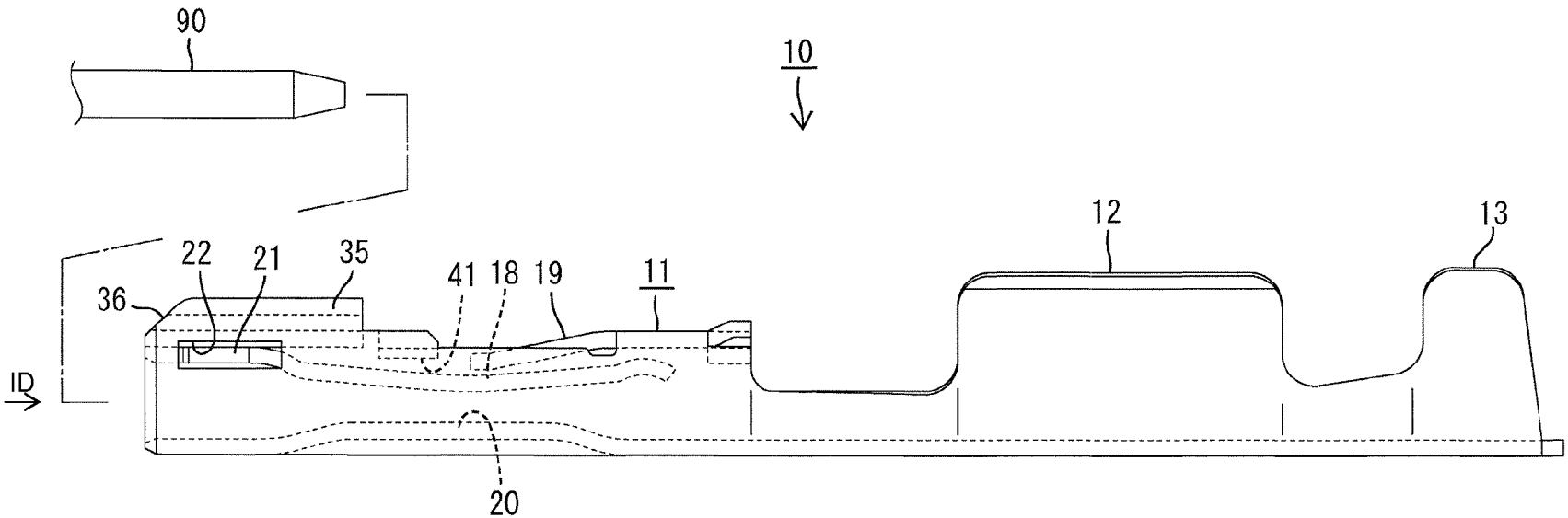
FIG. 4 is another side view of the terminal fitting.
Figure 8:
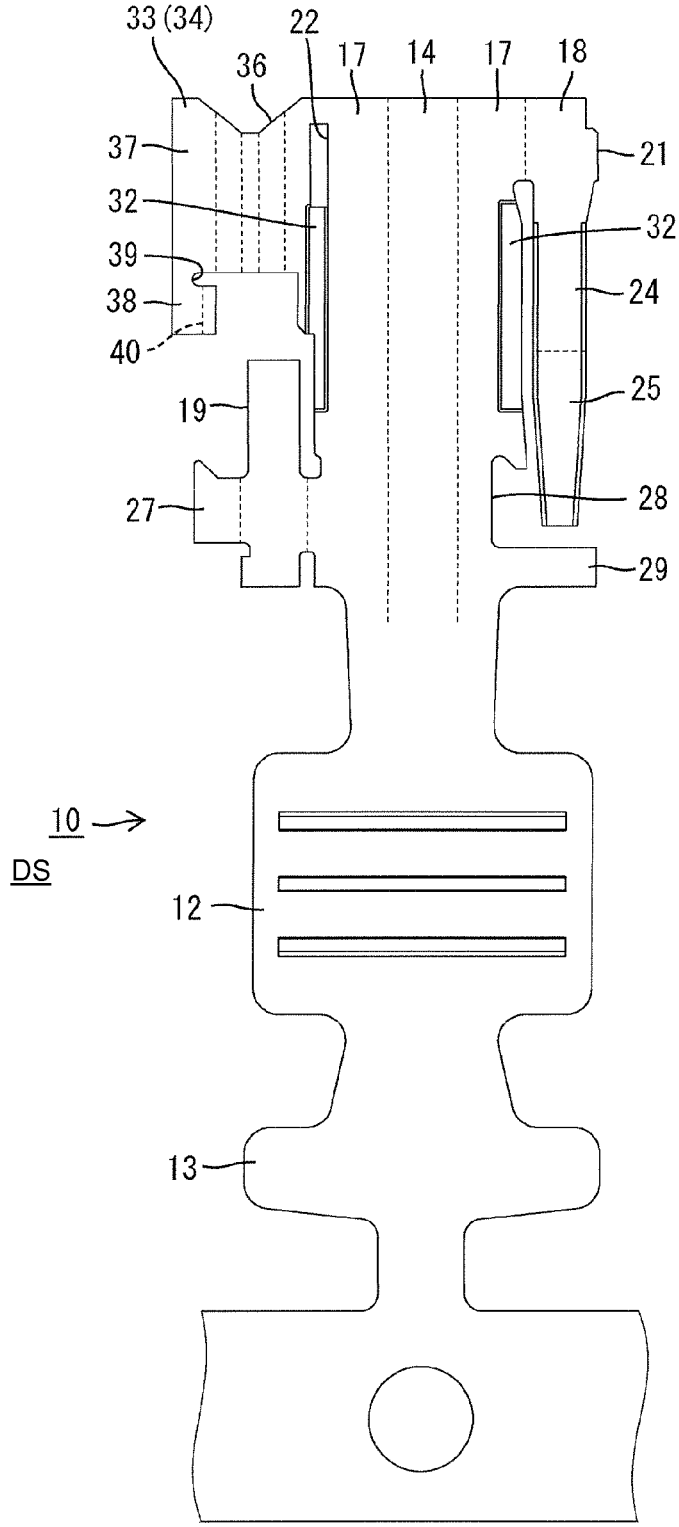
FIG. 8 is a development view of the terminal fitting.

As shown in FIGS. 4 and 8, an insertion piece 21 projects sideways at a side of the resilient contact 18 opposite the first side plate 17 and is received in a slit-like insertion window 22 in an upper end of the second side plate 17.

Figure 5:
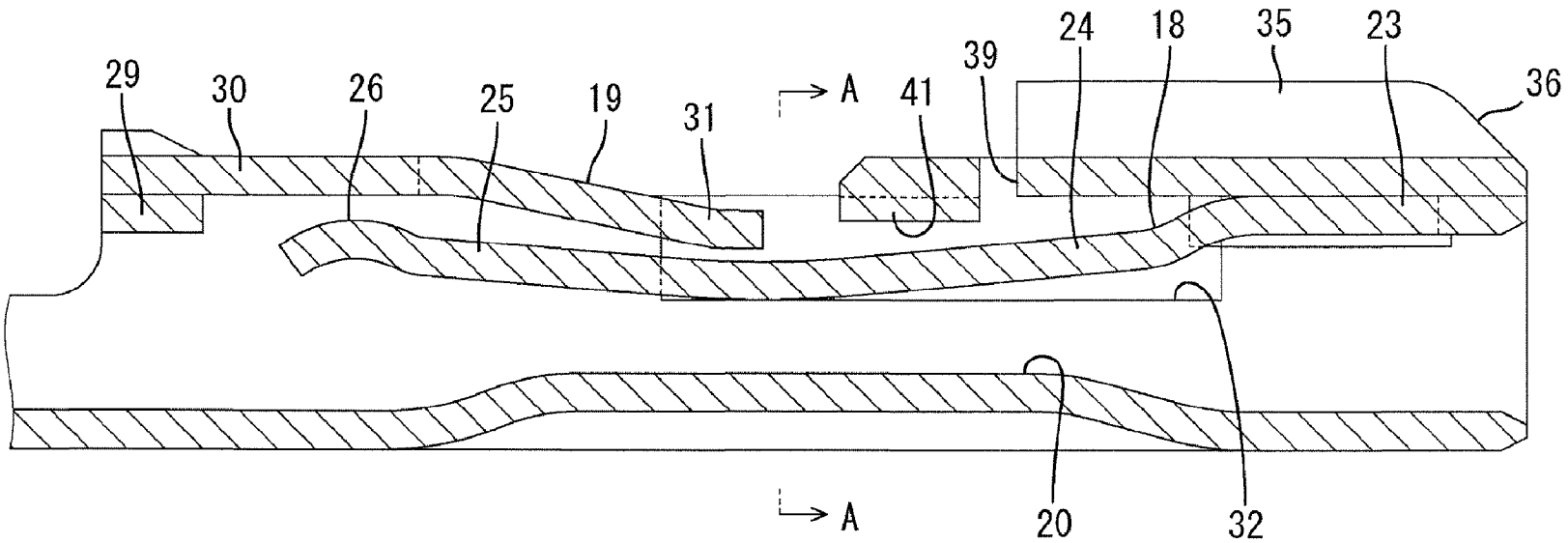
FIG. 5 is a section of a rectangular tube when viewed sideways

As shown in FIG. 5, the resilient contact 18 has a front panel 23 bent at a substantially right angle from a front end portion of the first side plate 17 to extend substantially parallel to the base plate 14. A moderately inclined intermediate panel 24 extends back from the rear end of the front panel 23 and projects into the interior of the tube 11. A rear panel 25 extends back from the rear of the intermediate panel 24 and has a width that gradually narrows toward the free end of the rear panel 25. The intermediate panel 24 and the rear panel 25 are resiliently deformable in a direction intersecting an inserting direction ID of the male tab 90 into the tube 11 (e.g. up and down in a height direction) with a position of the intermediate panel 24 near the front panel 23 as a support. The entire resilient contact 18 has a width to be accommodated between the two side plates 17.

A pressing portion 26 is formed at the free end of the rear panel 25 and is curved slightly to define an upwardly convex surface. The pressing portion 26 contacts a support 19 as described herein so that the resilient contact 18 is supported at three points by the pressing portion 26, the support 19, and the front panel 23.

Figure 7:
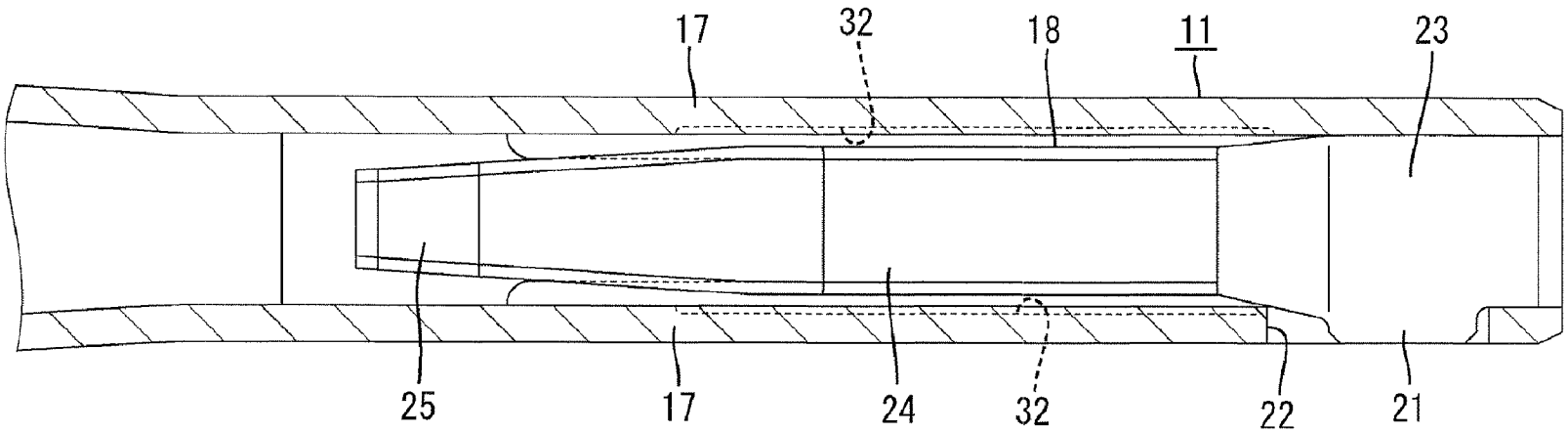
FIG. 7 is a section of the rectangular tube when viewed from below.

As shown in FIG. 7, the insertion piece 21 is formed at a lateral edge of the base panel 23 and is inserted into the insertion window 22. The insertion piece 21 engages the edge of the insertion window 22 in a widthwise direction to hinder an off-center alignment of the resilient contact 18. The rear end of the rear panel 25 is near a rear end portion of the rectangular tube 11.

As shown in FIGS. 1 and 8, a dovetail-shaped wing 27 projects from a side of the support 19 opposite the second side plate 17. A dovetail-shaped cutout 28 is formed in the upper end of the first side plate 17 at a position corresponding to the wing 27. A receiving piece 29 projects from the upper end of the first side plate 17.

The support 19 has a rear panel 30 bent at a right angle from a rear part of the second side plate 17 so that the rear panel 30 extends substantially parallel to the base plate 14. A front panel 31 extends forward from the front end of the rear panel 30 and projects into the interior of the tube 11. The front panel 31 is resiliently deformable in a direction intersecting an inserting direction ID of the male tab 90 into the tube 11 with the rear panel 30 as a support. The front panel 31 of the support 19 has a uniform width that is substantially equal to the width of an intermediate part of the rear panel 25 of the resilient contact 18. The wing 27 is bent down at a right angle to extend along the first side plate 17 and engages with the cutout 28. Further, the receiving piece 29 is bent at a substantially at a right angle from the first side plate 17 to be inwardly of the rear panel 30 for preventing the rear panel 30 from dropping into the interior of the tube 11.

Figure 2:
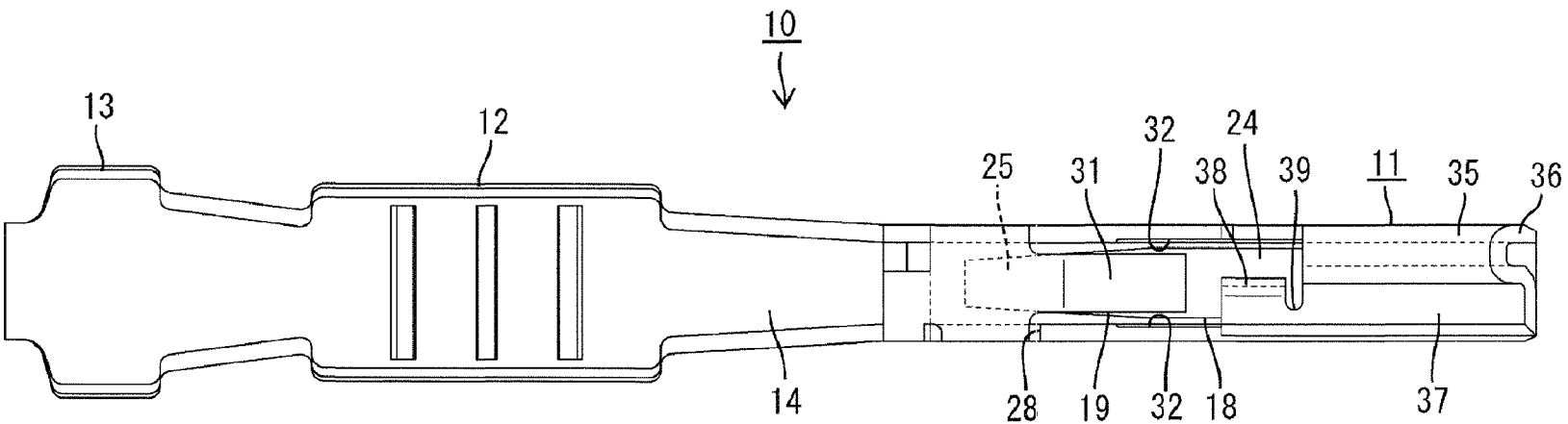
FIG. 2 is a plan view of the terminal fitting.

As shown in FIG. 2, the front panel 31 of the support 19 is above the rear panel 25 of the resilient contact 18 and overlaps the rear panel 25 of the resilient contact piece 18 in the outward resilient deforming direction. A clearance is present between the front panel 31 of the support 19 and the rear panel 25 of the resilient contact 18. The front panel 31 interferes with the rear panel 25 of the resilient contact 18 and deforms with the resilient contact 18.

First and second bottomed recesses 32 are formed respectively on the inner surfaces of first and second side plates 17 for permitting the resilient contact piece 18 to escape. The recesses 32 cover a deformation region where the resilient contact piece 18 is displaced. The recesses 32 are narrow and long in forward and backward directions, and have flat bottom surfaces parallel to the inner and outer surfaces of the side plates 17. The recesses 32 are accommodated within the thicknesses of the side plates 17.

Figure 6:
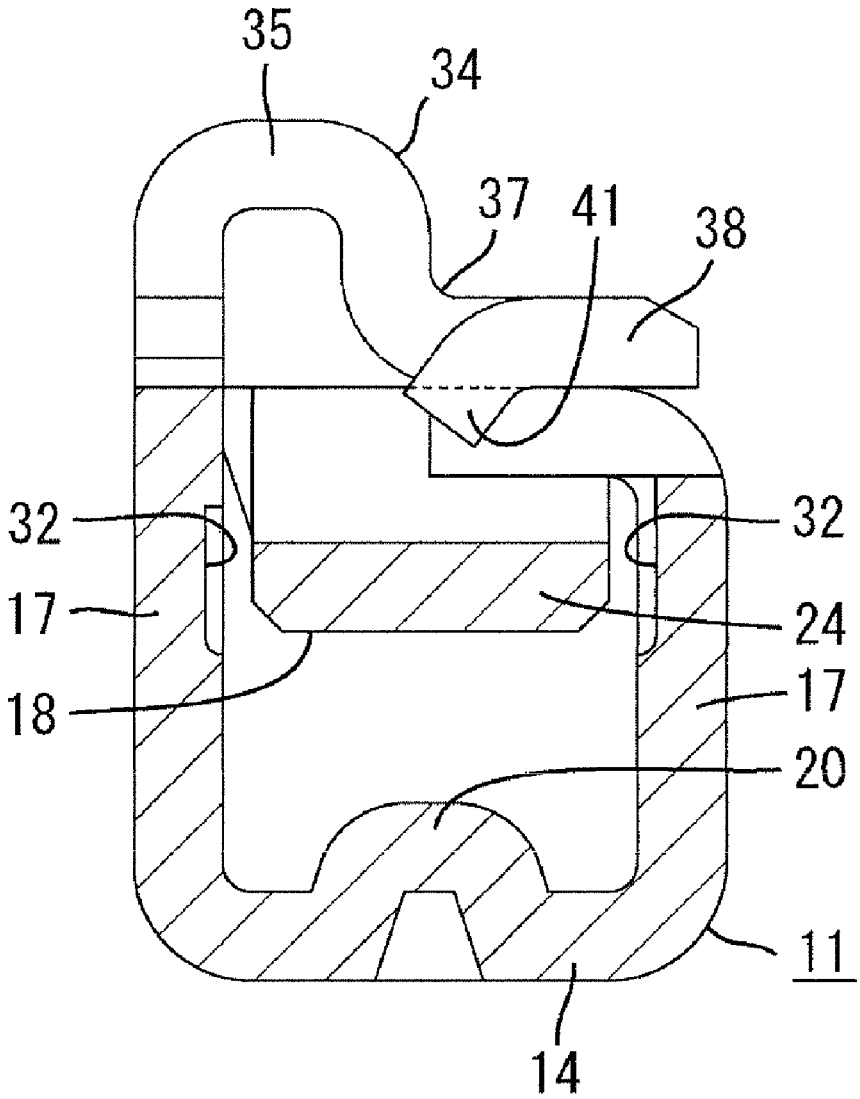
FIG. 6 is a section along A-A of FIG. 5.

The front ends of the recesses 32 are rearward of an insertion opening of the tube 11 for the male tab 90. The recesses 32 are substantially adjacent to the front panel 23 and the intermediate panel 24 of the resilient contact 18, and the rear ends of the recesses 32 are at positions aligned with front parts of the rear panel 25 of the resilient contact 18. The first recess 32 opens at the upper end of the first side plate 17 and the second recess 32 opens at the upper end of the second side plate 17 except for a part corresponding to an extending portion 33. The front end of the second recess 32 is at substantially the same position as the rear end of the insertion window 22. As shown in FIG. 6, the recesses 32 are between the inner surfaces of the side plates 17 in the height direction, and the resilient contact 18 is deformed resiliently within this height range.

Figure 3:
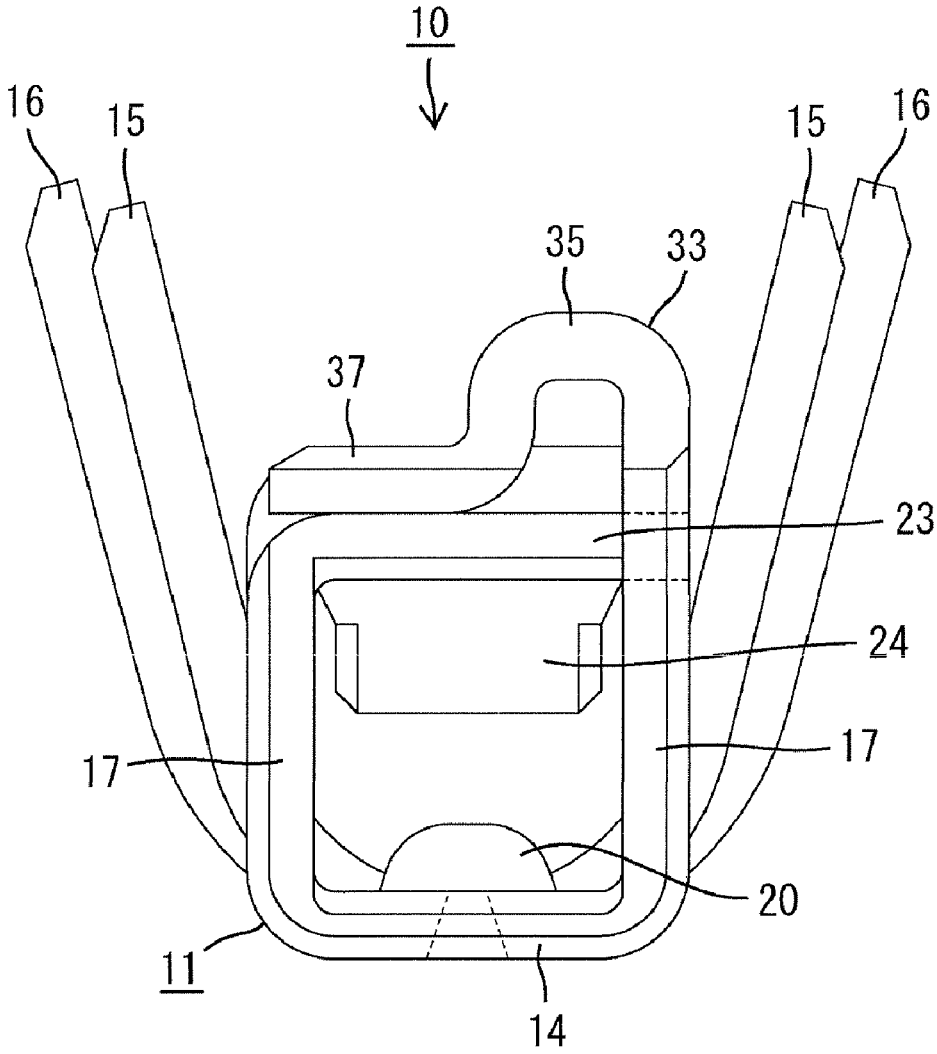
FIG. 3 is a front view of the terminal fitting.

As shown in FIGS. 3 and 8, the terminal fitting 10 also includes the extending portion 33 projecting out from a lateral edge of one of the side plates 17 of the tube 11 in a developed state DS before being bent and placed on the front panel 23 and the intermediate panel 24 of the resilient contact 18 from the outer side. This extending portion 33 is bent to form a stabilizer 34.

The stabilizer 34 is at the front end of the terminal fitting 10 and includes a stabilizer main body 35 formed into an outwardly projecting rib by bending the extending portion 33. The stabilizer main body 35 enters a guiding groove in the cavity of the connector housing to guide the terminal fitting 10 into the cavity and to prevent the terminal fitting 10 from being inserted erroneously. The front end of the stabilizer main body 35 is formed into a slant 36 that slopes down and in for guiding the terminal fitting 10 into the cavity.

The stabilizer 34 also includes a skirt 37 that extends out along the front panel 23 of the resilient contact 18 while being connected with a lateral end of the stabilizer main body 35, as shown in FIGS. 2 and 3. A rectangular projection 38 projects back from the rear outer edge of the skirt 37 in the developed state DS shown in FIG. 8. A slit 39 is formed at a connected part of the projection 38 and the skirt 37. The slit 39 extends in the width direction and has an open inner side.

A bending line 40 extends in forward and backward directions at an inner surface of the projection 38 and at an open side of the slit 39. An excessive deformation preventing portion 41 is formed by bending the inner end of the projection 38 in along the bending line 40. The excessive deformation preventing portion 41 faces the intermediate panel 24 of the resilient contact 18 in the resilient deforming direction and hinders excessive deformation of the resilient contact piece 18 by contacting the intermediate panel 24 when the resilient contact piece 18 is deformed excessively. As shown in FIG. 6, the excessive deformation preventing portion 41 is connected with the outer side of the projection 38 at an obtuse angle (preferably between about 100° and 150°) and inclines to horizontal and vertical axes when viewed from the front, and is bent substantially in a widthwise intermediate part of the tube 11 so that the leading end faces a widthwise intermediate part of the intermediate panel 24 of the resilient contact 18. A projecting distance of the excessive deformation preventing portion 41 into the interior of the rectangular tube 11 preferably is less than the plate thickness.

To form the terminal fitting 10, both side plates 17 are bent at opposite lateral sides of the base plate 14. The resilient contact 18 then is bent at the upper end of the first side plate 17. As a result, the insertion piece 21 enters the insertion window 22 and the resilient contact 18 extends between the two side plates 17. The extending portion 33 then is bent multiple times to form the stabilizer main body 35. The projection 38 is bent along the bending line 40 to project into the interior of the tube 11, thereby forming the excessive deformation preventing portion 41. The receiving piece 29 is bent at the upper edge of the first side plate 17 and the support 19 is bent at the upper edge of the second side plate 17 and placed on the outer side of the receiving piece 29.

The skirt 37 is placed on the outer side of the front panel 23 of the resilient contact 18 to increase the rigidity of the front panel 23. The rear panel 25 of the resilient contact 18 and the front panel 31 of the support 19 overlap each other. The recesses 32 of the side plates 17 face the opposite lateral edges of the resilient contact 18 from the outer sides. The male tab 90 can be inserted into the front end of the tube 11 and is held resiliently between the receiving portion 20 and the resilient contact 18 for electrically connecting the male tab 90 and the terminal fitting 10. At this time, the resilient contact 18 deforms resiliently together with the supporting piece 19, receives an insertion force of the male tab 90 while being supported at three points, and gives an appropriate resilient force to the male tab 90. Additionally, the intermediate panel 24 of the resilient contact 18 interferes with the excessive deformation preventing portion 41 to prevent deformation beyond the resiliency limit of the resilient contact 18.

The opposite lateral edges of the male tab 90 slide on the inner surfaces of both side plates 17 at an insertion opening end to prevent the male tab 90 from shaking in the width direction in the process of inserting the male tab 90. Even at a stage where the insertion depth of the male tab 90 is increased, the opposite lateral edges of the male tab 90 are arranged to be slidable substantially on the inner surfaces of both side plates 17 to prevent the male tab 90 from shaking in the width direction. In other words the opposite lateral edges of the male tab 90 enter the recesses 32 so that there is no likelihood of reducing connection stability due to shaking movements of the male tab 90 in the width direction.

The excessive deformation preventing portion 41 is utilized when there is little available space in the tube 11. The excessive deformation preventing portion 41 is formed by bending a part of the extending portion 33 projecting out from the end edge of the tube 11 into the interior of the tube 11. The stabilizer 34 is formed in the extending portion 33 to maximizing space efficiency. Additionally, the excessive deformation preventing portion 41 is formed by bending the projecting piece 38 projecting from the end edge of the region forming the stabilizer 34 into the interior of the tube 11. Thus, the shape of the excessive deformation preventing portion 41 is not restricted by the stabilizer 34 and a degree of freedom in forming the excessive deformation preventing portion 41 is increased. Thus, the excessive deformation preventing portion is applicable to a small terminal fitting 10.

The plate surface of the excessive deformation preventing portion 41 is arranged along the inserting direction ID of the male tab 90. Thus, the tube 11 is not enlarged in the width direction orthogonal to the inserting direction ID of the male tab 90 and the terminal fitting 10 can be miniaturized even further. Moreover, since the panels 25, 31 of the resilient contact 18 and the support 19 overlap, space efficiency is higher than in the case where the resilient contact piece 18 and the support 19 are arranged to distance the panels 25, 31 from each other. Further, the resilient contact 18 and the support 19 resiliently deform in cooperation. Hence, the resilient rigidity of the resilient contact 18 is increased and a large contact pressure between the resilient contact 18 and the male tab 90 is ensured even in the small terminal fitting 10.

The recesses 32 are formed at positions of the inner surfaces of the side plates 17 that include the resilient displacement range of the resilient contact 18 and permit the resilient contact 18 to escape. Therefore, the resilient contact 18 will not interfere with the side plates 17 and will deform smoothly resilient even if the male tab 90 causes the resilient contact 18 to deform in an off-center manner. Additionally, the recesses 32 are bottomed recesses. Thus, the lateral edges of the resilient contact 18 are covered by the side plates 17 to prevent an external matter from laterally interfering with the resilient contact 18.

The recesses 32 are arranged within the thicknesses of the side plates 17 and therefore do not increase the width of the tube 11. Thus, the width of the cavity of the connector housing that receives the terminal fitting 10 is not increased. Hence, the terminal fitting 10 and the connector can be miniaturized.

Since the recesses 32 are formed in the range including the intermediate panel 24 of the resilient contact 18 and the intermediate panel 24 of the resilient contact 18 is wider than the rear panel 25 thereof. Thus, the resilient rigidity of the intermediate panel 24 is increased and a large contact pressure between the resilient contact 18 and the male tab 90 is ensured.

The intermediate panel 24 of the resilient contact 18 substantially faces the insertion opening of the tube 11 for the male tab 90. Thus, the male tab 90 becomes more difficult to rotate about an axis due to the contact with the resilient contact 18, thereby ensuring smooth insertion of the male tab 90.

The recesses 32 are formed at the positions retracted from the insertion opening of the rectangular tube 11 for the male tab 90. Thus, a distance between the inner surfaces of the side plates 17 can be set in conformity with the width of the male tab 90 at the insertion opening end of the tube 11 for the male tab 90. Accordingly, the male tab 90 will not shake in the width direction at an initial stage of the inserting operation.

The recesses 32 are arranged in parts of the height ranges of the both side plates 17. Therefore, the distance between the inner surfaces of the side plates 17 can be set substantially in conformity with the width of the male tab 90 and the male tab 90 is prevented from shaking in the width direction even after insertion into the rectangular tube 11.

The invention is not limited to the above described and illustrated embodiment. For example, the following embodiments are also included in the technical scope of the present invention.

The extending portion may not have the function of the stabilizer.

The extending portion may be bent entirely to form the excessive deformation preventing portion.

The stabilizer main body may be formed by forming a cut in the extending portion and bending a part inside this cut e.g. out to project outside of the cross-sectional area of the tube portion.

The recess may be formed only in the inner surface of one side plate.

The front ends of the recesses may be aligned with the front ends of the side plates. Further, the rear ends of the recesses may be aligned with the rear ends of the side plates.

The supporting piece may be omitted.

Even though the tube is described with respect to a rectangular tube portion in the above embodiment, it should be understood that the invention is applicable to tubes having different configurations such as a tube having a substantially polygonal cross-sectional configuration.

What is claimed is:

1. A terminal fitting formed by bending an electrically conductive plate, comprising:

a tube having a base plate and two substantially parallel side plates extending up from the outer sides of the base plate;

a resilient contact formed in the tube and opposed to the base plate, the resilient contact being disposed for contacting a male tab inserted into the tube between the resilient contact and the base plate;

an extending portion projecting out from the tube at a position opposed to the base plate; and an excessive deformation preventing portion extending from the extending portion, the excessive deformation preventing portion being bent inwardly toward the base plate so that an edge of the excessive deformation preventing portion is arranged at an outer side of the resilient contact for contacting the resilient contact and preventing deformation of the resilient contact beyond a resiliency limit.

2. The terminal fitting of claim 1, wherein the extending portion is bent to form a stabilizer that projects from the tube for guiding insertion into a connector housing and preventing an erroneous insertion into the connector housing, and the excessive deformation preventing portion being formed by bending a part of the extending portion projecting from an end edge of the stabilizer into the tube.

3. The terminal fitting of claim 2, wherein the excessive deformation preventing portion has a plate surface arranged substantially along an inserting direction of the male tab.

4. The terminal fitting of claim 1, wherein:

the resilient contact extends substantially in an inserting direction of the male tab from a intermediate panel that defines a supporting point of resilient deformation to an rear panel thereof;

a support formed in the tube and having a rear panel and a front panel projecting from the rear panel in a direction substantially opposite to the inserting direction of the male tab; and the resilient contact and the support overlap each other in a resilient deforming direction.

5. The terminal fitting of claim 1, wherein the tube has an open front end for receiving the male tab, the resilient contact being cantilevered rearward from a support in proximity to the open front end.

6. A terminal fitting comprising:

a tube for receiving a mating male tab;

a resilient contact in the tube for resiliently contacting the male tab and being resiliently deformable in a resilient deforming direction; and opposite side plates of the tube being arranged substantially parallel with the resilient deforming direction of the resilient contact, at least one bottomed recess formed in an inwardly facing surface of at least one of the side plates in a range in which the resilient contact is resiliently deformed for permitting the resilient contact to escape, wherein the at least one recess is formed at a position of the tube retracted from an insertion opening for the male tab, and wherein the at least one recess is arranged in a part of a height range extending along the resilient deforming direction.

7. The terminal fitting of claim 6, wherein the at least one recess is arranged within a thickness of the side plate.

8. The terminal fitting of claim 6, wherein:

the resilient contact has an intermediate panel defining a resilient deformation supporting point and a rear panel extending from the intermediate panel and being narrower than the intermediate panel; and the at least one recess being formed in a range including the intermediate panel of the resilient contact.

9. The terminal fitting of claim 8, wherein the intermediate panel of the resilient contact substantially faces an insertion opening end of the tube for the male tab.

10. A terminal fitting formed by bending an electrically conductive plate, comprising:

a tube having a base plate and two substantially parallel side plates extending up from the outer sides of the base plate;

a resilient contact formed in the tube and disposed for contacting a male tab inserted into the tube;

an extending portion projecting out from the tube; and an excessive deformation preventing portion extending from the extending portion, the excessive deformation preventing portion being bent inwardly and arranged at an outer side of the resilient contact for contacting the resilient contact and preventing deformation of the resilient contact beyond a resiliency limit; wherein the extending portion is bent to form a stabilizer that projects from the tube for guiding insertion into a connector housing and preventing an erroneous insertion into the connector housing, and the excessive deformation preventing portion being formed by bending a part of the extending portion projecting from an end edge of the stabilizer into the tube.

11. The terminal fitting of claim 10, wherein the excessive deformation preventing portion has a plate surface arranged substantially along an inserting direction of the male tab.

12. The terminal fitting of claim 10, wherein:

the resilient contact extends substantially in an inserting direction of the male tab from a intermediate panel that defines a supporting point of resilient deformation to an rear panel thereof;

a support formed in the tube and having a rear panel and a front panel projecting from the rear panel in a direction substantially opposite to the inserting direction of the male tab; and the resilient contact and the support overlap each other in a resilient deforming direction.

* * * * *